US009120543B2

(12) United States Patent
Toce

(10) Patent No.: US 9,120,543 B2
(45) **Date of Patent: *Sep. 1, 2015**

(54) BOAT HOIST APPARATUS AND METHOD OF USE

(71) Applicant: Eric Toce, Lafayette, LA (US)

(72) Inventor: Eric Toce, Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/227,318

(22) Filed: Mar. 27, 2014

(65) Prior Publication Data

US 2015/0191230 A1 Jul. 9, 2015

Related U.S. Application Data

(60) Provisional application No. 61/923,388, filed on Jan. 3, 2014.

(51) Int. Cl.
*B63C 3/06* (2006.01)
*B63C 3/12* (2006.01)

(52) U.S. Cl.
CPC .... *B63C 3/06* (2013.01); *B63C 3/12* (2013.01)

(58) Field of Classification Search
CPC ..... B63C 3/06
USPC ..... 405/3; 114/45, 48
See application file for complete search history.

(56) References Cited

U.S. PATENT DOCUMENTS

| | | | | |
|---|---|---|---|---|
| 2,444,240 | A | 6/1948 | Bayer | |
| 2,632,900 | A * | 3/1953 | Voigt | 114/365 |
| 2,646,474 | A | 7/1953 | Stratton | |
| 3,012,757 | A * | 12/1961 | Marzolf | 254/280 |
| 3,021,965 | A * | 2/1962 | Harvey | 405/3 |
| 231,342 | A | 4/1974 | Johnson | |
| 233,119 | A | 10/1974 | Johnson | |
| 3,990,320 | A | 11/1976 | Habiger | |
| 4,624,450 | A | 11/1986 | Christison | |
| 4,725,764 | A | 2/1988 | Prestel | |
| 4,973,094 | A | 11/1990 | Tana et al. | |
| 5,287,821 | A * | 2/1994 | Godbersen | 405/3 |
| 5,436,415 | A | 7/1995 | Smith et al. | |
| 5,569,891 | A | 10/1996 | Freeman et al. | |
| 5,657,696 | A | 8/1997 | Bishop | |
| 5,957,623 | A * | 9/1999 | Sargent et al. | 405/3 |
| 6,194,675 | B1 | 2/2001 | Greer | |
| 6,474,256 | B1 | 11/2002 | Vogel | |
| 6,786,170 | B2 | 9/2004 | Trowbridge | |
| 6,872,900 | B1 | 3/2005 | Lament et al. | |

(Continued)

FOREIGN PATENT DOCUMENTS

| | | |
|---|---|---|
| EP | 1724231 | 11/2006 |
| EP | 1710473 | 1/2009 |

*Primary Examiner* — Frederick L Lagman

(57) ABSTRACT

A boat hoist apparatus for accessible manipulation of toggle switches of a boat hoist control. The boat hoist is comprised of a boat hoist control box, a winch, winch cables, and a boat cradle. The boat hoist switch handle is comprised of a vertical rotatable control shaft mounted on upper and lower bearing brackets, a switch control lever, middle and lower horizontal handles attached to the control shaft, a pivoting. connection link between the switch control lever and the first hoist switch, and a pivoting connection link between the first hoist switch and the second hoist switch. Rotation of the control shaft by means of the lower or middle horizontal handle will pivot the switch control lever in the same direction and simultaneously turn the first and second hoist toggle switches by weans of the pivoting links, actuating the boat hoist control box to raise or lower a boat.

20 Claims, 7 Drawing Sheets

(56) References Cited

U.S. PATENT DOCUMENTS

| | | | |
|---|---|---|---|
| 7,176,395 | B2 | 2/2007 | Holland |
| 7,227,322 | B2 | 6/2007 | Alipour et al. |
| 8,269,119 | B2 | 9/2012 | Grul et al. |
| 2006/0185464 | A1 | 8/2006 | Telep et al. |
| 2010/0212576 | A1 | 8/2010 | Muller |
| 2011/0206457 | A1 | 8/2011 | Schoon |
| 2012/0263534 | A1 | 10/2012 | Heller |

* cited by examiner

BOAT HOIST APPARATUS AND METHOD OF USE

PRIORITY

This application claims priority to U.S. provisional application Ser. No. 61/923,388 filed Jan. 3, 2014 ended "Boat Hoist Apparatus and Method of Use", the entire content of which is hereby incorporated by reference.

FIELD OF THE INVENTION

The invention relates generally to boat hoist apparatus with an accessible linkage for controlling inaccessible hoist switches at a boat dock and, more particularly, to a linkage which allows for manipulation of elevated inaccessible hoist control box toggle switches from the deck of the boat dock or from a boat at the water surface.

BACKGROUND OF THE INVENTION

Keeping a boat out of the water when the boat is not in use reduces wear and tear on the boat hull caused by marine organisms, corrosion, and the effects of wind and waves. Boats are often kept out of the water by means of a boat lift fitted to a boat dock. Many boat slips, boat houses, or other boat docking facilities, both recreational and commercial, have a boat lift system to raise and lower a boat from and to the water surface. Often the boat lift system is used to lift the boat to a level high above the water surface, often to a level above the boat dock deck surface. These situations occur when the boat docking facility is subjected to shallow water conditions, or when there are highly fluctuating water levels around the boat docking facility, or when the boat docking facility is subjected to rough water conditions brought on by wind and waves.

Such boat lift systems often utilize a winch connected to a network of cables and pulleys mounted on support piling or other framework positioned around a boat slip. These cables support boat cradles that hold a boat within the boat slip as the boat is raised and lowered. Depending upon the construction of the boat dock facility, the lift framework, and the weight of the boat to be lifted, such boat lift systems may have two or more winches to manipulate the cables supporting the boat cradles. The winches work together when lifting the boat into and out of the water and are controlled to stop or move up and down by a hoist control box having a toggle switch or lever, When two or more inches are used in a lift system, each winch typically has a separate hoist control box that has a separate toggle switch or lever. The toggle switches of the hoist control boxes are typically three position switches. The three positioned switches are arranged so that the toggle switches may be pivoted or toggled to a first or neutral position where the winch is inactive, to a second position where the hoist is engaged to lift the boat, and a third position where the hoist is engaged to lower the boat.

These toggle switch control boxes are often located high up on the boat dock framework, at eye level or higher, in order to keep the toggle control boxes out of the water during high water conditions such as during a high tide. On return to the dock in a low tide or low water situation, a user who enters the boat slip, unless there is third party assistance at the dock, is either forced to climb out of the boat and up a ladder, if one is available, or pull himself up onto the boat dock deck directly from the boat in order to exit the boat and reach the control switches. In either case, the user is greatly inconvenienced at best and at worst, is subject to the risk of fall and injury.

Remote control devices for hoist control switches have been utilized but replacing or refitting control switches on existing boat lift systems to incorporate remote control devices is expensive. Consequently, it can be appreciated that there exists a continuing need for a new and inexpensive device to allow a boat user to manipulate the elevated control switches of boat lift systems. Further, allowing the user to enter the boat and then manually manipulate the elevated switches directly from the boat during both high and low water conditions will minimize the inconvenience and risks noted above with existing manual controlled boat switches. A further need exists for a device that may be added to existing boat lift systems at a minimal cost in order to provide a user greater flexibility in the use and manipulation of the toggle switches of the hoist control boxes.

SUMMARY OF THE INVENTION

The present invention is directed to address the aforementioned needs and provides a toggle switch linkage apparatus for manipulation of toggle switched control boxes of a boat hoist assembly. The toggle switch linkage apparatus allows for simultaneous control of two or more toggle switched control boxes controlling the winches and cables of a boat lift assembly used to raise and lower the boat cradles of the lift system.

The toggle switch linkage apparatus includes an elongated, axially extending, control rod or shaft that is rotatably mounted on support brackets attached to a pylon or other framework in the area around the boat slip of a boat dock where the boat lift assembly is installed. The control shaft of the assembly is mounted to extend axially downward from the control box of a boat hoist. The length of the control shaft may be varied to allow the bottom to the shaft to be oriented at a desired position with respect the deck of the boat dock.

A plurality of control levers or handles are attached to the control shaft. The control handles extend radially outward from the control shaft and are spaced apart along its length at desired intervals. Any number of control handles may be provided. Preferably, a control handle will be placed near the top, the middle, and the bottom of the control shaft. The control handles are used to rotate or pivot the control shaft about its vertical axis on the support brackets and provide a means to manually rotate the control shaft from a plurality of positions along the shaft.

A toggle link is pivotally attached to the toggle switch of a hoist control box and the top handle of the control shaft. Rotation of the control shaft about its vertical axis by any of the plurality of control handles will rotate the top handle of the control shaft and, by means of the toggle link, correspondingly move the toggle switch of the hoist control box. If the boat lift assembly has a second adjacent hoist control box, a second toggle link may be pivotally connected between the toggle switch of the second hoist control box and the toggle switch of the first hoist control box. When the toggle switches of each hoist control box are connected in this manner, rotation of the control shaft about its vertical axis will rotate the top handle of the control shaft and correspondingly move the toggle switches of each hoist control box by means of the toggle links. The toggle switches of any number of adjacent hoist control boxes may be connected to the top handle of the control shaft by an array of pivotally attached links positioned between the toggle switches and the top control handle.

Because of the marine environment incident to its use, the components of the toggle switch linkage apparatus is preferably made of corrosion resistant material such as stainless steel or marine grade aluminum.

For use, the toggle switch linkage apparatus is assembled with the control shaft of the apparatus rotatably mounted, by means of support brackets, in a vertical position on a pylon or framework at a position proximate to a first toggle switched hoist control box or a series of adjacent toggle switched hoist control boxes of a boat lift assembly with the top handle of the control shaft positioned proximate to the toggle switch of the first hoist control box. The remaining control handles may be positioned vertically along the control shaft at desired locations. Such control handle locations on the control shaft may be at a level conveniently accessible troth the deck surface of a boat dock or at a level conveniently assessable from a boat on the water surface. The toggle switch of the hoist control box, or multiple hoist control boxes, are then pivotally attached to the top control handle and, if multiple control boxes to each other, by means of a toggle link or a series of toggle links.

When a user desires to lower a boat supported m a lilted position by the cradle of a boat lift assembly to place the boat into the water for use, the control shaft is rotated or pivoted by means of a control handle, such as a control handle conveniently accessible from the deck surface of the boat dock. This rotation will manipulate the toggle switch or switches of the boat hoist control box and raise or lower the boat as desired. The user may first raise or lower the boat by rotation and counter-rotation of the control shaft to move the toggle switch or switches of the boat control box or boxes to a desired position to engage the hoist to raise or lower the boat. The control handle may be used to stop the boat at a desired level so that the boat is placed at a position where the user and any passengers may conveniently enter the boat from the boat dock deck surface. Once the user and any passengers are in the boat, the toggle switch or switches of the boat control box or boxes control may be manipulated by rotation to the control shaft to lower the boat to the water surface and, if necessary continue to lower the boat lift cradle so that the boat is clear of the support cradle. The lower control handle proximate to the water surface may then be used to stop the hoist and the boat may then be moved away from the cradle and the boat slip for use.

When the user returns the boat to the dock, the boat may then be positioned in the boat slip above the boat cradle. The user may then use the lower control handle, proximate to the water surface, to rotate the control shaft to manipulate the toggle switches of the hoist control box or boxes to a lift position so that the hoist or hoists will lift the boat from the water. When the boat is lifted to the level of the boat dock deck surface, the user may use the control handle conveniently accessible from the deck surface of the boat dock to rotate the control shaft so that the toggle switches of the hoist control box or boxes are moved to the neural or stopped position to stop the boat at to position where the user and any passengers may conveniently exit the boat onto the boat dock deck surface. After exiting, the control handle may be rotated to lift or lower the boat to a desired position.

As noted above, any one of the control handles of the toggle switch linkage apparatus may be used to rotate the control shaft and pivot the toggle switches of the hoist control boxes. The toggle switch linkage apparatus provides a mechanism for a lone user to use a boat lift assembly to move a boat to and from the water surface. There is no need for assistance from a third party. The boat may be lifted and lowered with the hoist control box or boxes mounted at an otherwise inaccessible elevated position with respect to the boat dock deck surface and the water surface. This allows for the hoist control box or boxes to be placed in a protected position to prevent the control box or boxes from being submerged in high water conditions. This will prolong the service life of the control boxes and minimize the need for repairs.

DESCRIPTION OF THE EMBODIMENTS

Figure 1:
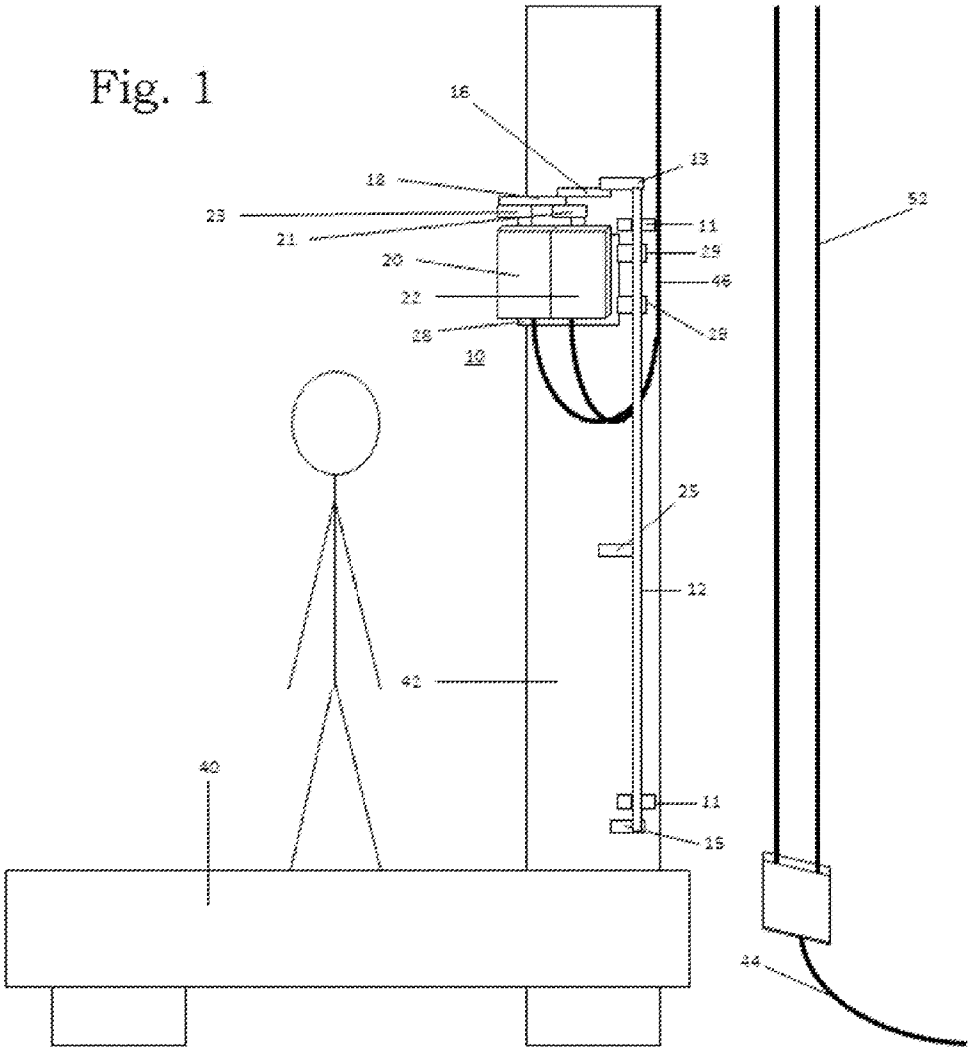
FIG. 1 is an elevation view of the embodiment of the toggle switch linkage apparatus attached for manipulation of the toggle switches of toggle switched control boxes of a boat hoist assembly as described herein.

Referring now to the drawings and, more particularly to FIG. 1, there is shown a plain view of the embodiment of the boat hoist 10 attached to the framework 42 of a boat dock, slip, pier, or other equivalent boat docking site 40. The framework may be a pylon, post, girder, beam, wall, or other elevated structural segment of docking site 40 where boat hoist control boxes 20 and 22 may be affixed.

Specifically the hoisting mechanism of apparatus 10 has two independent hoist control boxes 20 and 22, two independently controlled winches 50, a boat cradle 44 connected to winches 50 which are raised or lowered by articulation of boxes 20 and 22. The control mechanism of apparatus 10 has a vertically disposed control shaft 12, upper and lower bearing brackets 11 which attach shaft 12 to framework 42, a switch control lever 13 at the top of shall 12, a lower handle 15 placed at the bottom of shaft 12, a middle handle 25 placed towards the middle of shaft 12, a first pivoting connecting link 16 which connects switch control lever 13 to first hoist toggle switch 21 of box 22, and a second pivoting connecting link 18 which connects first hoist toggle switch 21 to second hoist toggle switch 23 of box 20.

Brackets 11 hold shaft 12 in place on framework 42 while allowing for pivoting of shaft 12 around its vertical axis when manipulated by switch control lever 13, middle handle 25, or lower handle 15. Rotation of shaft 12 by means of lower handle 15 or middle handle 25 will pivot the switch control lever 13 in the same direction and simultaneously turn the first 21 and second 23 hoist toggle switches by means of the pivoting rods 16 and 18. Manipulation of first 21 and second 23 hoist toggle switches will cause boat hoist boxes 20 and 22 to actuate sending a signal through hoist control wires 46 to winches 50 which will wind winch cables 52 up or out causing boat cradle 44 to raise or lower boat 48.

Shaft 12 will be composed of stainless steel, marine grade aluminum, or any other corrosion resistant material. The length of shaft 12 may be altered to fit a desired length on framework 42 as to suit common water conditions of an area. The length of shaft 12 may be altered to reach to the deck of docking site 40 or even may be extended to below the deck to accommodate articulation of shaft 12 during low water conditions. Shaft 12 may be affixed with middle 25 or lower 15 handles at desired levels to suit common water conditions of an arc or to befit a user's preference. Any number of handles 15 and 25 may be implemented along the length of shaft 12 to allow for user accessibility and ease of use.

Figure 2:
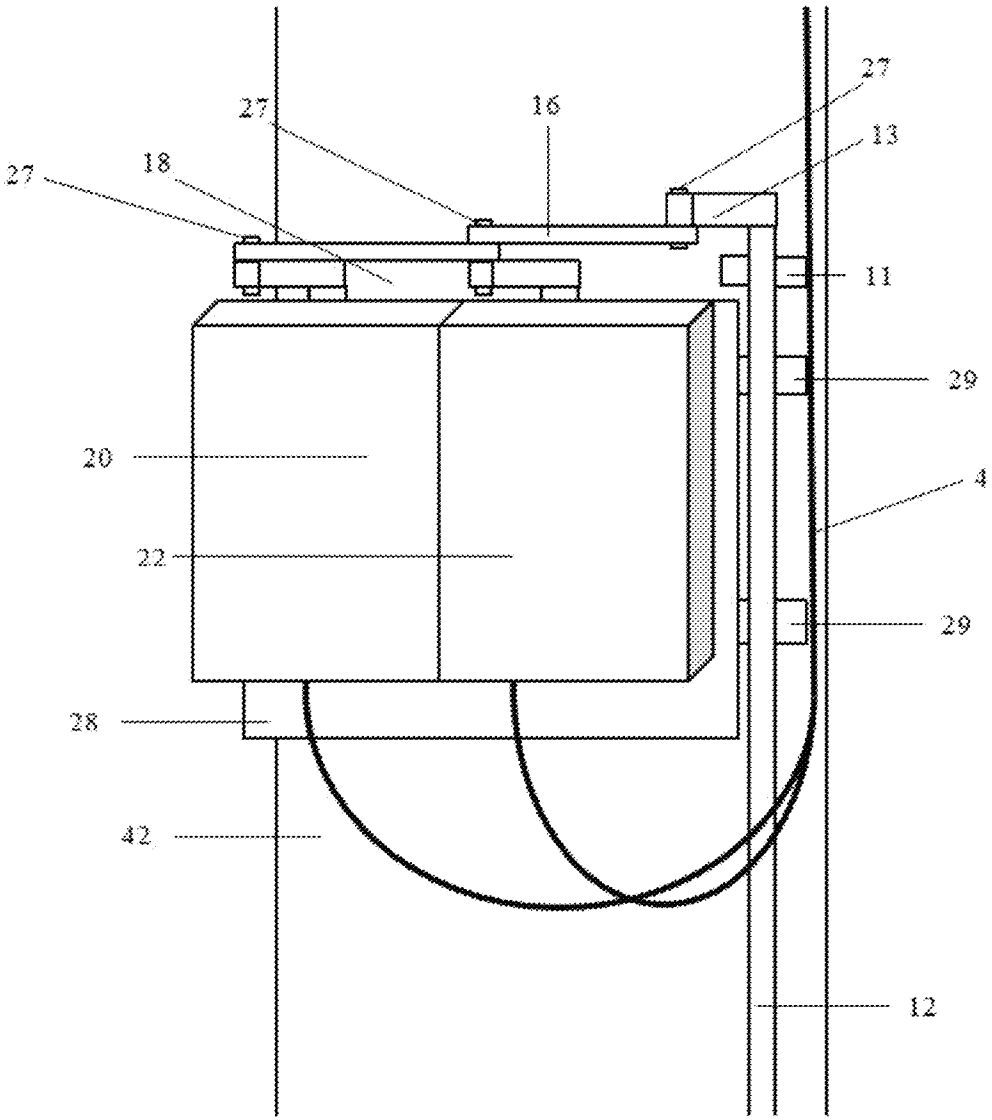
FIG. 2 is a detail elevation view of the toggle switch linkage of the toggle switch linkage apparatus of FIG. 1 attached to the toggle switches of a boat hoist control box.
Figure 3:
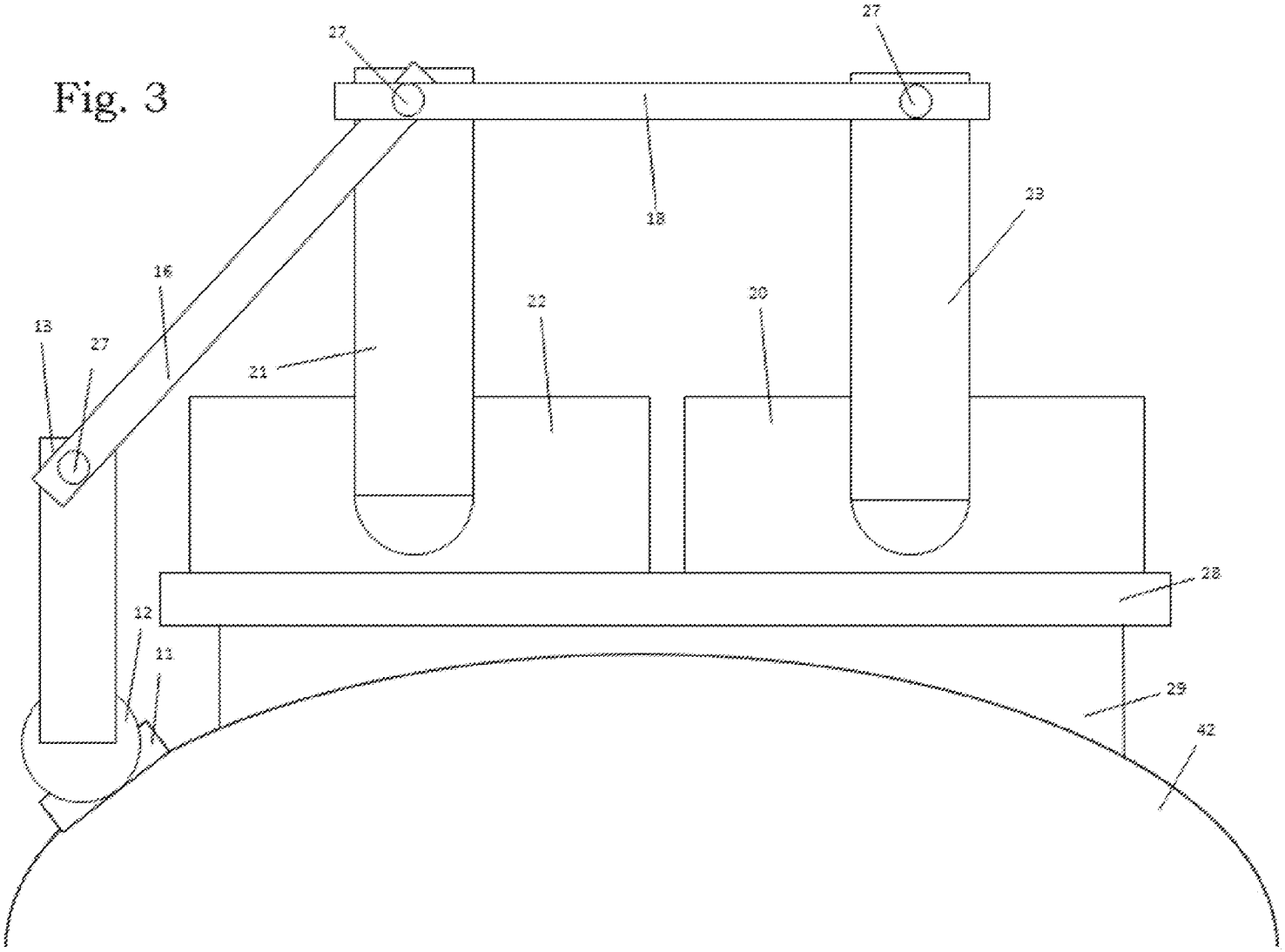
FIG. 3 is a top view of the toggle switch linkage of the toggle switch linkage apparatus of FIG. 1 attached to the toggle switches of a boat hoist control box.

Referring now to FIGS. 2 and 3, there is shown a close-up view of the control boxes 20 and 22 of apparatus 10, specifically showing the attachment of hoist toggle switches 21 and 23 with shaft 12. Where framework 42 has an uneven or rounded surface, control boxes 20 and 22 may be affixed to the flat surface of mounting bracket 28 which can be affixed to framework 42 by mounting surfaces 29. Attachment of control boxes 20 and 22 to the flat surface of mounting bracket 28 allows for identical reciprocation of first 21 and second 23 hoist toggle switches. Control boxes 20 and 22 are affixed to mounting bracket 28 by screws, bolts, or any other equivalent attachment means. Mounting bracket 28 may be affixed to framework 42 by mounting surfaces 29 by screws, nails, bolts, or any other equivalent attachment means. Mounting surfaces 29 may be adjusted to meet and attach to any shape of framework 42. In instances where the shape of the dock framework 42 is round, surfaces 29 will be curved to meet the surface of framework 42. Where framework 42 is square shaped, surfaces 29 will project arms straight so as to meet the flat side surfaces of the square framework 42. As well surfaces 29 may be adjusted to fit any alternate shape to which framework 42 may be constructed.

First pivoting connecting link 16 is threadedly attached to upper horizontal handle 13 on one end and threadedly attached to first hoist toggle switch 21 on the other by pivots 27. Second pivoting connecting link 18 is threadedly attached to first 21 and second 23 hoist toggle switches on either end by pivots 27. Rotation of shaft 12 by means of the lower handle 15 or middle handle 25 will pivot the switch control lever 13 in the same direction and simultaneously turn the first 21 and second 23 hoist toggle switches by means of the pivoting links 16 and 18. Manipulation of first 21 and second 23 hoist toggle switches will cause boat hoist boxes 20 and 22 to actuate sending a signal through hoist control wires 46 to winches 50 which will wind winch cables 52 up or out and cause boat cradle 44 to raise or lower boat 48.

FIG. 3 shows a top view of the control boxes 20 and 22 of apparatus 10. Shaft 12 is pivotally bracketed to framework 42 by bracket 11. Mounting surfaces 29 run across the back surface of mounting bracket 28 perpendicular to the vertical axis of framework 42 as to create a flush attachment surface for mounting surface 29 to attach to framework 42 while providing a stable surface for attachment of control boxes 20 and 22. When switch control handle 13 is rotated, depending on the direction rotated, first pivoting connection link 16 will push or pull against first hoist toggle switch 21 which will push or pull second pivoting connection link 18 which in turn will push or pull second hoist toggle switch 23. Rotation of first 21 and second 23 hoist toggle switches in either direction will actuate boat hoist boxes 20 and 22. First pivoting connection link 16 is pivotally connected to switch control lever 13 and first hoist toggle switch 21 by pivots 27. As well, second pivoting connection link 18 is pivotally connected to first hoist toggle switch and second hoist toggle switch by pivots 27.

In typical operation, hoist toggle switches 21 and 23 will remain in the "off" position where the hoist control boxes 20 and 22 will not be actuated until switch control handle 13, middle handle 25, or lower handle 15 are toggled. An operator will be able to choose whichever actuation means, 13, 15, or 25, is easily accessible for manipulation and upon turning, depending upon the direction manipulated, the hoist control boxes 20 and 22 will cause winches 50 to raise or lower boat 48 on cradle 44.

Figure 4A:
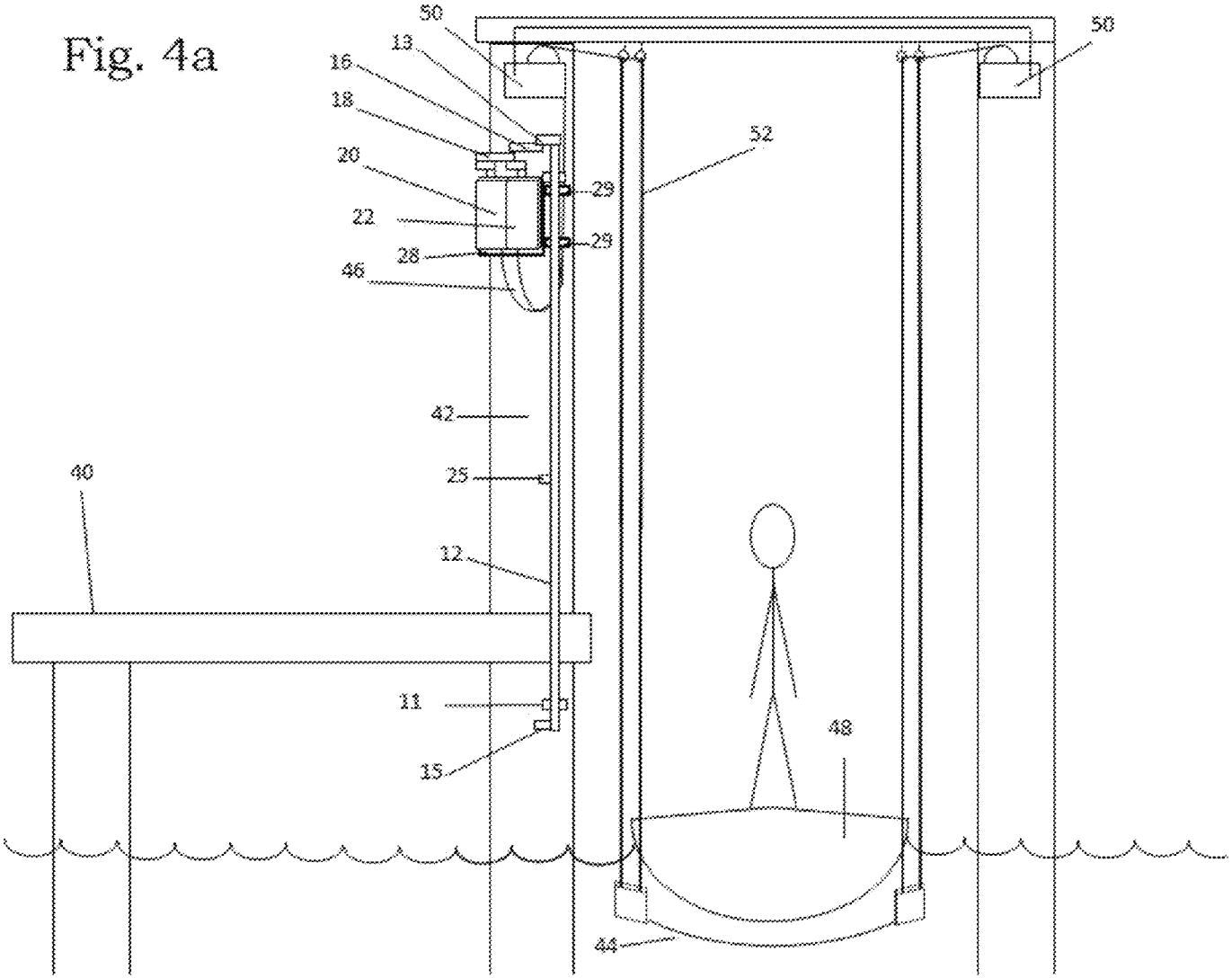
FIGS. 4*a*, 4*b*, 4*c* are elevation views of the apparatus of FIG. 1 in use to raise or lower a boat into water.
Figure 4B:
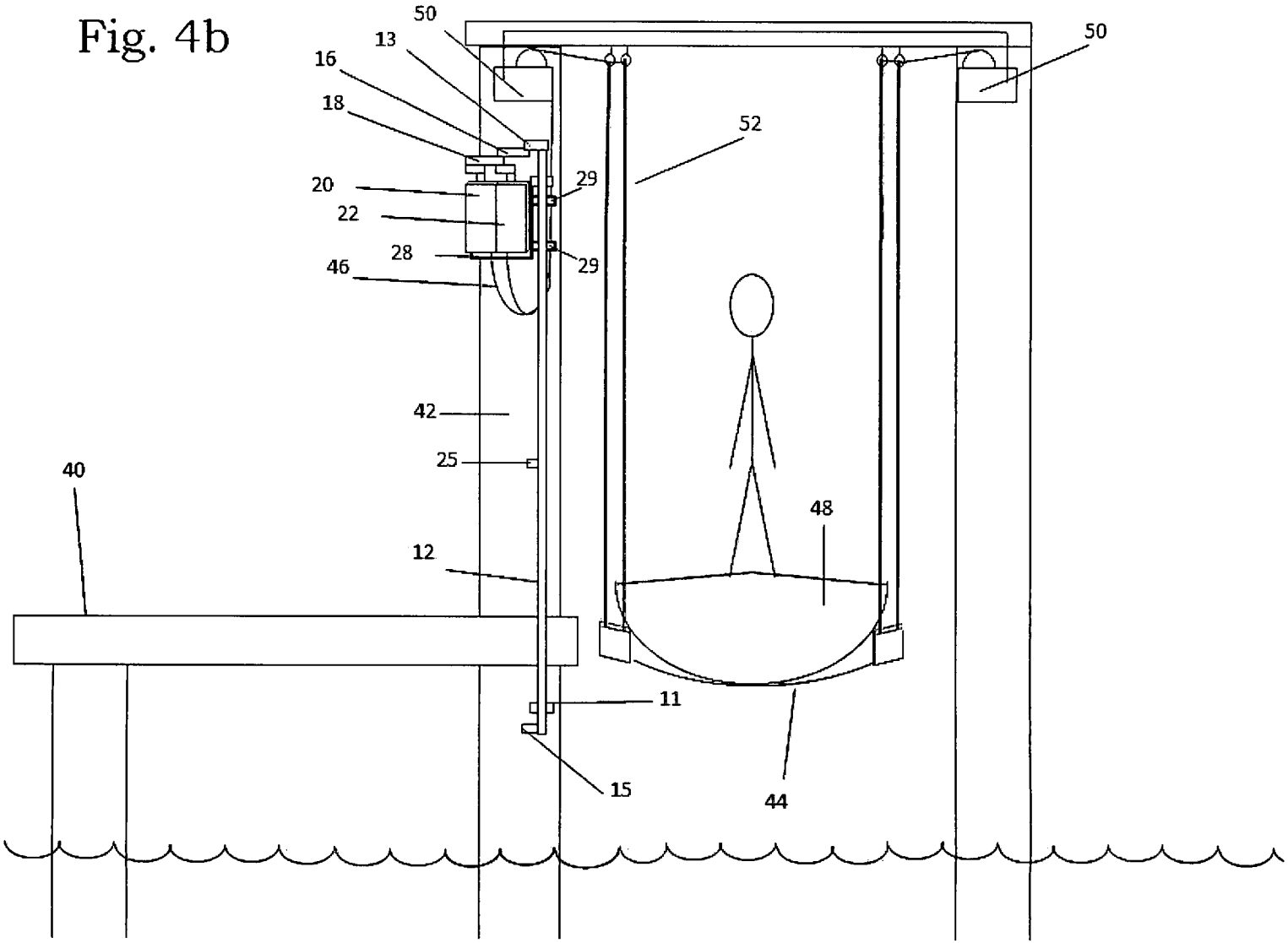
Figure 4C:
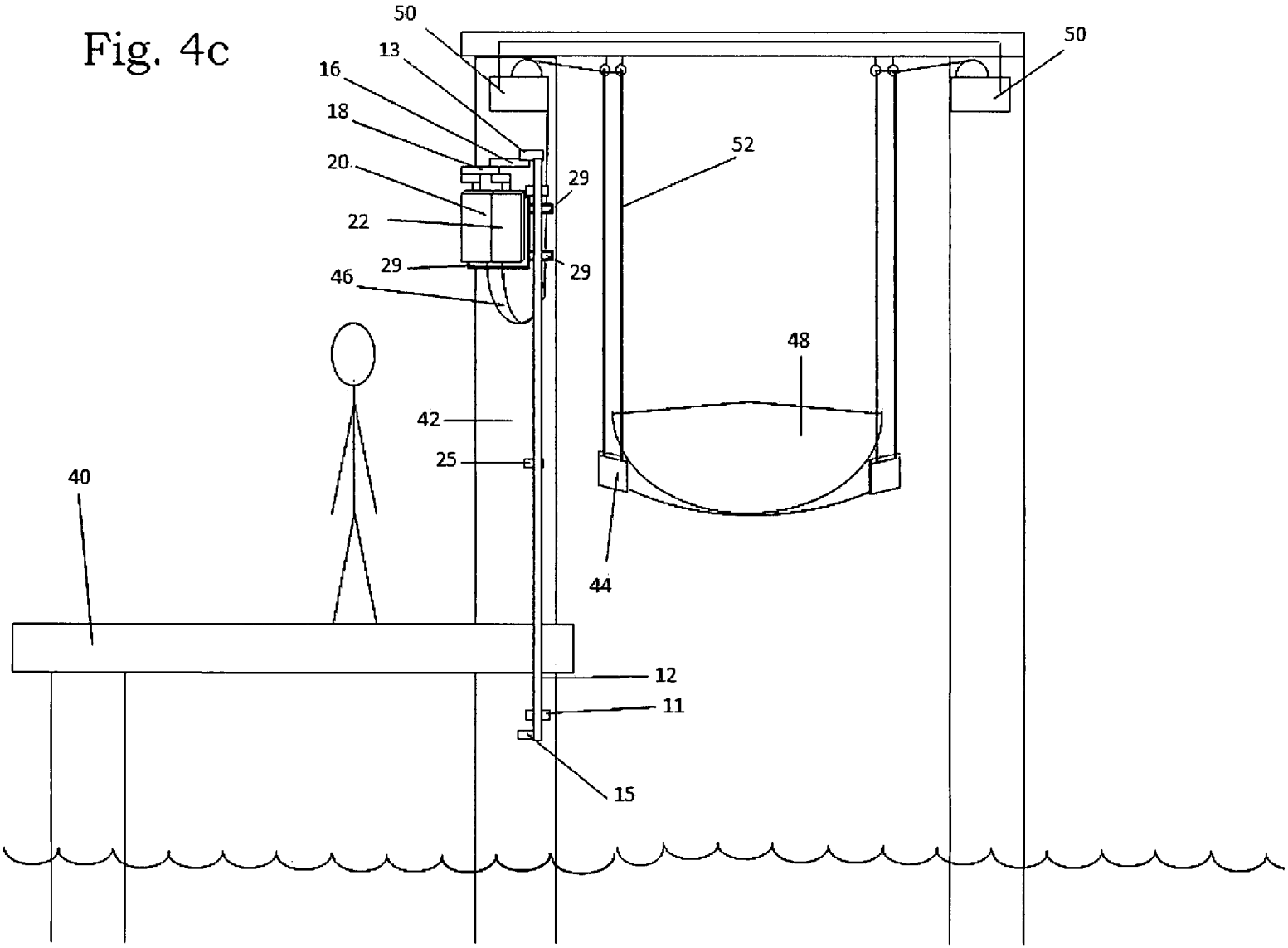

Referring to FIG. 4*a*, while in boat 48 during normal or low tide conditions where hoist toggle switches 21 and 23 are inaccessible or otherwise difficult to reach, an operator may position their boat 48 over cradle 44 and remain in boat 48. Lower handle 15 or middle handle 25, if accessible, on shaft 12 will allow the operator to actuate toggle switches 21 and 23 to hoist boat 48 out of the water without requiring the operator to climb onto the deck of docking site 40. Upon reaching a level where boat 48 begins to be raised above lower handle 15, lower handle 15 may be released allowing hoist toggle switches 21 and 23 to return to their off position and stop boat 48 from ascending. The user may then rotate middle handle 25 to continue raising boat 48. As shown in FIG. 4*b*, once boat 48 has reached a desired level with dock 42 a user can stop rotating handle 15 or 25, which will stop boat 48 from being lifted by cradle 44, and the user and any passengers may then safely step out onto the deck of docking site 40. As shown in FIG. 4*c*, it desired after exiting boat 48 onto the deck of docking site 40 a user may then further lift boat 48 by rotating middle handle 25 or switch control lever 13 which will articulate control boxes 20 and 22 to lift boat 48 on cradle 44. Upon boat 48 reaching a desired height, a user may stop rotating middle handle 25 or control lever 13 and cradle 44 will stop lifting boat 48.

To lower boat 48 off of cradle 44 and into the water, a user present on the dock may articulate control lever 13 or middle handle 25 which will articulate control boxes 20 and 22 to lower boat 48 on cradle 44. Upon boat 48 reaching a desired level to the deck of docking site 40, the operator may stop rotating control lever 13 or middle handle 25, which will stop boat 48 from being lowered upon cradle 44, and the user and any passengers may then enter boat 48. Middle handle 25 may continue to be used until boat 48 has been lowered sufficiently where middle handle 25 can no longer be reached. After which, the user may use lower handle 15 to completely lower boat 48 where boat cradle 44 is no longer supporting boat 48.

Alternatively, an operator may raise or lower boat 48 into or out of the water using control lever 13, lower handle 15, or middle handle 25 alone.

Figure 5:
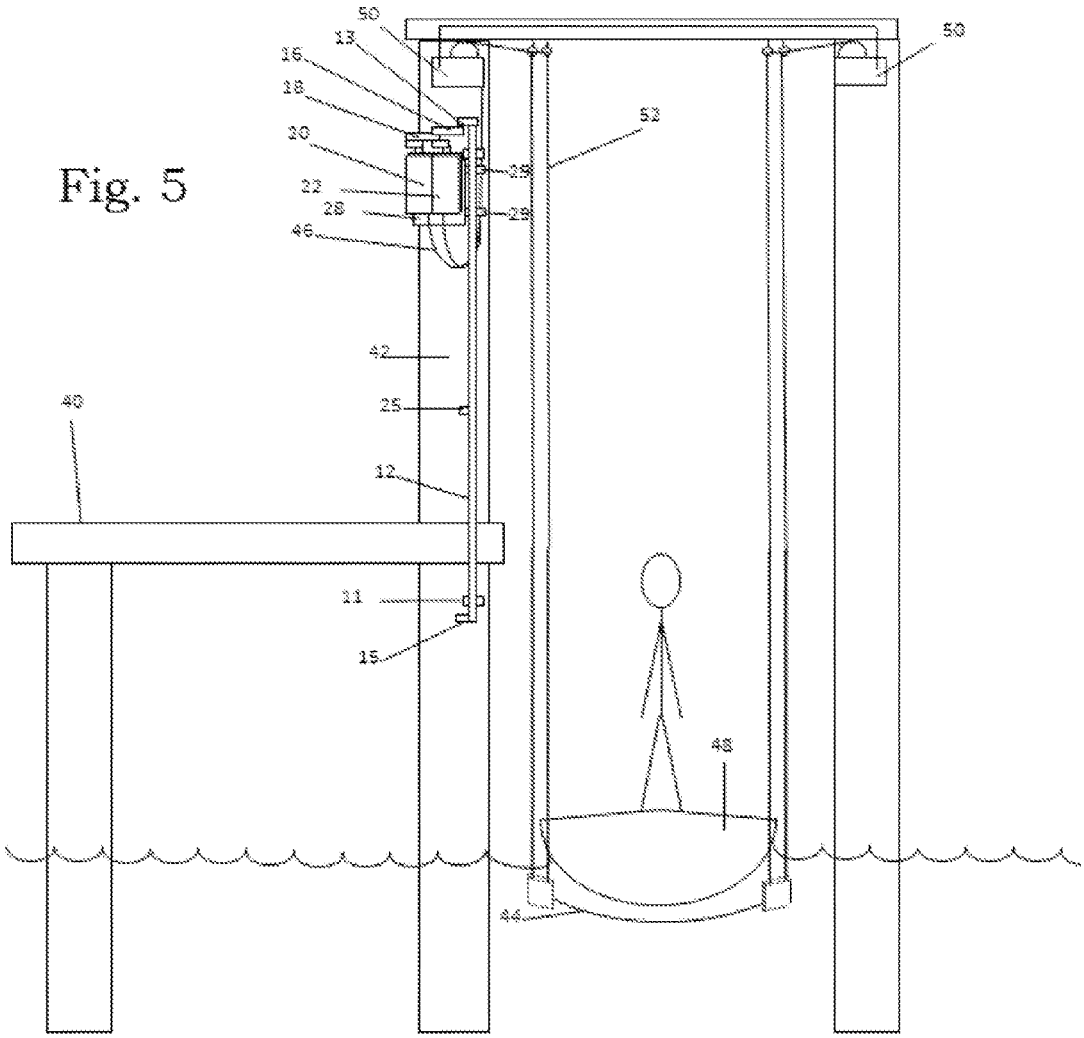
FIG. 5 is a plain view of the apparatus used during low water conditions.

FIG. 5 shows the apparatus with an extended shaft for use during low water conditions. Manipulation of toggle switches 21 and 23 may be difficult or otherwise impossible during low water conditions where the deck of docking site 40 is inaccessible to a user in boat 48. Shaft 12 can be extended down below the deck to enable a person in boat 48 to lift boat 48 out of the water and to a desired level without requiring the user to risk serious bodily injury by attempting to climb out of boat 48 onto the deck of docking site 40.

Rotation of lower handle 15 will articulate control boxes 20 and 22 causing boat cradle 44 to contact and lift boat 48 out of the water. Upon reaching a level where boat 48 begins to rise above lower handle 15, lower handle 15 may be released to stop boat 48 from ascending and the user may then rotate middle handle 25 to continue raising boat 48. Upon reaching a desired level a user may stop rotation of middle handle 25 to stop boat 48 from being raised and may safely exit boat 48. If the user wishes to continue raising boat 48, they may then rotate middle handle 25 or control lever 13 to further raise boat 48 to their desired level.

I claim:

1. A boat hoist apparatus for hoisting a boat into or out of water comprising:

(a) at least one boat hoist control box having at least one toggle switch, said boat hoist control box attached to a framework of a boat docking site;

(b) a winch controlled by said boat hoist control box;

(c) a boat hoist connected to said winch;

(d) a shaft vertically oriented and pivotally bracketed to said framework adjacent to said boat hoist;

(e) a switch control lever attached to the top of said shaft;

(f) a handle attached to said shaft; and (g) a pivoting link attaching said switch control lever to said boat hoist toggle switch of said boat hoist control box.

2. The apparatus as in claim 1 further comprising said handle is attached at the bottom of said shaft.

3. The apparatus as in claim 2 further comprising a second handle attached near the middle of said shaft.

4. The apparatus as in claim 3 wherein said boat hoist control box is attached to said framework of said docking site by a mounting bracket.

5. In a switch control assembly comprising:

(a) a boat hoist assembly having a control toggle switch;

(b) a shaft vertically oriented and pivotally bracketed to a framework adjacent to a boat hoist;

(c) a switch control lever attached to the top of said shaft;

(d) a handle attached to said shaft; and (e) a pivoting link attaching said switch control lever to said control toggle switch.

6. The switch control assembly as in claim 5 further comprising said handle is attached at the bottom of said shaft.

7. The switch control assembly as in claim 6 further comprising said handle is attached near the middle of said shaft.

8. The switch control assembly as in claim 7 wherein said boat hoist control box is attached to said framework of said docking site by a mounting bracket.

9. The switch control assembly as in claim 6 wherein said boat hoist control box is attached to said framework of said docking site by a mounting bracket.

10. In a boat hoist apparatus for hoisting a boat into or out of water, said apparatus comprising at least one boat hoist box haying at least one toggle switch for controlling a winch:

(a) a shaft vertically oriented and pivotally mounted adjacent said boat hoist box;

(b) a switch control lever attached to said shaft;

(c) a handle attached to said shaft whereby said shaft may be rotated; and (d) linkage pivotally attached to said switch control lever and said boat hoist toggle switch.

11. A boat hoist apparatus for hoisting a boat into or out of water comprising:

(a) two or more boat hoist control boxes having toggle switches, said boat hoist control boxes attached to a framework of a boat dock, slip, pier, or other equivalent boat docking site;

(b) a winch controlled by said boat hoist control boxes;

(c) a boat hoist connected to said winch;

(d) a shaft vertically oriented and pivotally bracketed to said framework adjacent to said boat hoist;

(e) a switch control lever attached to the top of said shaft;

(f) a handle attached to said shaft; and (g) pivoting links attaching said switch control lever to said boat hoist toggle switch and attaching each said toggle switch to each.

12. The apparatus as in claim 11 further comprising said handle is attached at the bottom of said shaft.

13. The apparatus as in claim 12 further comprising a second handle attached near the middle of said shaft.

14. The apparatus as in claim 13 wherein said boat hoist control box is attached to said framework of said docking site by a mounting bracket.

15. The apparatus as in claim 12 wherein said boat hoist control box is attached to said framework of said docking site by a mounting bracket.

16. A boat hoist apparatus for hoisting a boat into or out of water comprising:

(a) at least one boat hoist control box affixed to a framework, said boat hoist control box having at least one toggle switch, said boat hoist control box connected to a winch for sending signals to said winch when said toggle switch is actuated to raise or lower a boat;

(b) a shaft pivotally bracketed to said framework adjacent to said boat hoist control box, said shaft vertically oriented and projecting downward relative to said boat hoist box along said framework, said shaft is attached to said toggle switch to reciprocate said boat hoist box to control said winch; and (c) at least one handle attached to said shaft below said boat hoist control box for pivotally rotating said shaft to articulate said toggle switch of said boat hoist box.

17. A method of operating a boat hoist to lower a boat to the water comprising the steps of:

(a) providing at least one boat hoist control box with at least one toggle switch, said boat hoist control box controlling a boat hoist, said toggle switch attached by a switch control lever to a vertically oriented pivotable shaft disposed downward from said boat hoist control box, said shaft affixed with a middle and lower handle;

(b) rotating the switch control lever or middle handle which will pivot said boat hoist toggle switch to actuate the boat hoist to lower a desired boat;

(c) releasing said switch control lever or said middle handle from rotation when said boat hoist has lowered said boat to a desired height;

(d) entering said boat;

(e) rotating the lower handle which will pivot said boat hoist toggle switches to actuate said boat hoist to lower said boat; and (f) releasing said lower handle from rotation when said boat hoist has lowered said boat into the water where said boat hoist no longer supports said boat.

18. The method as in claim 17, further comprising raising or lowering may be accomplished by rotating said switch control lever, said middle handle, or said lower handle alone.

19. A method of operating an elongated pivoting boat hoist switch handle to raise a boat from the water to a dock comprising the steps of:

(a) providing at least one boat hoist control box with at least one toggle switch, said boat hoist control box controlling a boat hoist, said toggle switch attached by a switch control lever to a vertically oriented pivotable shaft disposed downward from said boat hoist control box, said shaft affixed with a middle and lower handle;

(b) rotating lower handle which will pivot boat said hoist toggle switches to actuate said boat hoist to raise a desired boat positioned over said boat hoist;

(c) releasing said lower handle from rotation when said boat hoist has raised said boat to a desired level;

(d) exiting said boat;

(e) rotating the switch control lever or middle handle which will pivot said boat hoist toggle switches to actuate said boat hoist to raise said boat; and (f) releasing said switch control lever or said middle handle from rotation when said boat hoist has raised said boat out of he water to a desired level.

20. The method as in claim 19, further comprising raising or lowering may be accomplished by rotating said switch control lever, said middle handle, or said lower handle alone.

* * * * *